US010438732B2

(12) United States Patent
Roberg

(10) Patent No.: US 10,438,732 B2
(45) Date of Patent: Oct. 8, 2019

(54) MONOLITHIC WIDEBAND TRIFILAR TRANSFORMER

(71) Applicant: TriQuint Semiconductor, Inc., Hillsboro, OR (US)

(72) Inventor: Michael Roberg, Plano, TX (US)

(73) Assignee: Qorvo US, Inc., Greensboro, NC (US)

( * ) Notice: Subject to any disclaimer, the term of this patent is extended or adjusted under 35 U.S.C. 154(b) by 549 days.

(21) Appl. No.: 15/141,296

(22) Filed: Apr. 28, 2016

(65) Prior Publication Data

US 2017/0076855 A1 Mar. 16, 2017

Related U.S. Application Data

(60) Provisional application No. 62/219,157, filed on Sep. 16, 2015.

(51) Int. Cl.
*H01F 17/00* (2006.01)
*H01F 19/04* (2006.01)

(52) U.S. Cl.
CPC ..... *H01F 19/04* (2013.01)

(58) Field of Classification Search
USPC ..... 336/105, 146, 147, 150
See application file for complete search history.

(56) References Cited

U.S. PATENT DOCUMENTS 4,724,602 A * 2/1988 Weissman ..... H01F 27/2823 29/605
2009/0085666 A1* 4/2009 Ohnishi ..... H03F 1/565 330/286
2010/0091521 A1* 4/2010 Hinds ..... H02J 9/061 363/15
2012/0314734 A1* 12/2012 Zierdt ..... H03H 7/0115 375/219
2013/0241308 A1* 9/2013 Bilbrey ..... G01R 33/3692 307/104
2014/0253246 A1* 9/2014 Mei ..... H03F 1/0288 330/295

OTHER PUBLICATIONS

Boulouard, Andre et al., "Analysis of Rectangular Spiral Transformers for MMIC Applications," IEEE Transactions on Microwave Theory and Techniques, vol. 37, No. 8, Aug. 1989, pp. 1257-1260.
Winslow, Thomas A., "Ultra Broadband MMIC Impedance Transformer," Proceedings of the 41st European Microwave Conference, Oct. 10-13, 2011, Manchester, UK, IEEE, pp. 854-857.

* cited by examiner

*Primary Examiner* — Elvin G Enad
*Assistant Examiner* — Kazi S Hossain
(74) *Attorney, Agent, or Firm* — Withrow & Terranova, P.L.L.C.

(57) ABSTRACT

Transformers that provide impedance transformations within integrated circuits (ICs) are disclosed. Embodiments of the transformers may include a plurality of conductors connected in series within one another wherein the conductors are arranged to form transmission lines. A first port, a second port, and a third port are coupled to the conductors so that impedance transformations can be provided between the first port and the second port. Some embodiments of the transformers are arranged so that the third port can be used to apply a bias signal. The arrangement between the conductors and the ports allows the transformer to provide impedance transformations between the first port and the second port over a relatively wide passband at high frequency ranges and with relatively small insertion losses.

18 Claims, 7 Drawing Sheets

MONOLITHIC WIDEBAND TRIFILAR TRANSFORMER

RELATED APPLICATIONS

This application claims the benefit of provisional patent application Ser. No. 62/219,157, filed Sep. 16, 2015, the disclosure of which is hereby incorporated herein by reference in its entirety.

FIELD OF THE DISCLOSURE

This disclosure relates to transformers for integrated circuits (ICs).

BACKGROUND

Transformers are often used to provide impedance transformations that match impedances between two ports. These transformers may be formed within integrated circuits (ICs) to provide impedance transformations. However, typical transformer arrangements have proven to perform poorly as signal frequencies have continued to climb. For example, well known transformer arrangements can only provide the desired impedance transformations within a relatively narrow passband. Furthermore, these transformer arrangements often have large sizing and spacing requirements which thereby result in high insertion losses and degraded power efficiency. Accordingly, transformer arrangements are needed that can provide impedance transformations over a greater frequency range and with lower insertion losses.

SUMMARY

This disclosure relates generally to transformers that provide impedance transformation within integrated circuits (ICs). Embodiments of the transformers may be provided as monolithic microwave integrated circuits (MMICs). In one embodiment, a transformer includes a first conductor, a second conductor, a third conductor, a first port, a second port, and a third port. The second conductor is connected in series with the first conductor, and the third conductor is connected in series with the second conductor. Furthermore, the first conductor and the second conductor are disposed so as to form a first transmission line, while the second conductor and the third conductor are disposed so as to form a second transmission line. The first port is coupled so as to provide an intermediary tap to the first transmission line. The second port is also coupled to the first conductor. Finally, the third port is coupled to the third conductor. The arrangement between the conductors and the ports allows the transformer to provide impedance transformations between the first and the second port. Furthermore, by providing the transmission lines with the conductors, the transformer can provide the impedance transformations over a relatively wide passband at high frequency ranges. The conductors can also be sized and arranged so as to significantly reduce insertion losses when compared to other transformer arrangements.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

Figure 1:
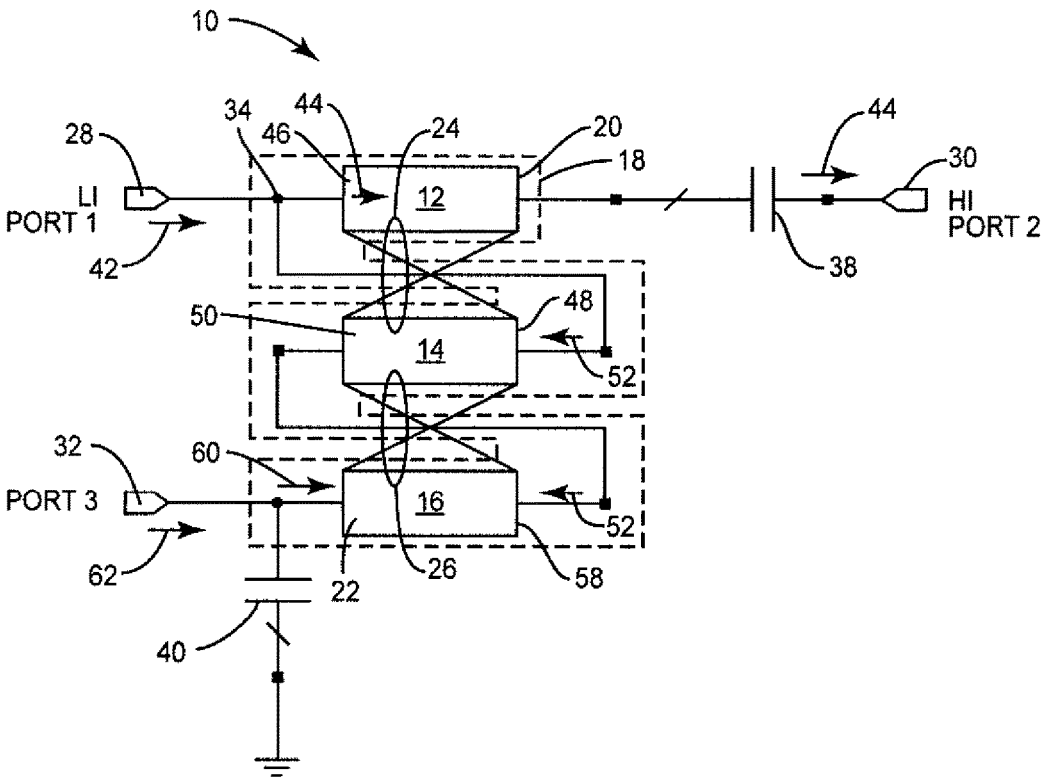
FIG. 1 illustrates one embodiment of a transformer having a plurality of conductors connected in series within a conductive path and forming transmission lines wherein signaling is shown in the transformer for transforming a low impedance presented at a first port to a high impedance presented at a second port.

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It should also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be understood that, although the terms "upper," "lower," "bottom," "intermediate," "middle," "top," and the like may be used herein to describe various elements, these elements should not be limited by these terms. These terms are only used to distinguish one element from another. For example, a first element could be termed an "upper" element and, similarly, a second element could be termed an "upper"

element depending on the relative orientations of these elements, without departing from the scope of the present disclosure.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Throughout this disclosure, relative terminology, such as "approximately," "substantially," "significantly" and the like, may be used in a predicate to describe features and relationships between features of a device or method. The relative terminology in the predicate should be interpreted sensu lato. However, whether the predicate employing the relative terminology is satisfied is determined in accordance to error ranges and/or variation tolerances relevant to the predicate and prescribed to the device or method by RF communication standards relevant to the RF application(s) employing the device or method. For example, the particular RF application employing the device or method may be designed to operate in accordance with certain communication standards, specifications, or the like. These communication standards and specification may prescribe the error ranges and/or variation tolerances relevant to the predicate or may describe performance parameters relevant to the predicate from which the error ranges and/or variation tolerances for the device or method can be deduced and/or inferred.

With regard to the term "port," a port refers to any component or set of components configured to input and/or output RF signals. To illustrate, a port may be provided as a node, pin, terminal, contact, connection pad, and/or the like or a set of the aforementioned components. For example, with regard to a single-ended signal, a port may be provided by a single node or a single terminal. However, in other embodiments for a differential signal, a port may be provided by a pair of terminals or nodes configured to receive and/or transmit differential signals.

Embodiments of transformers and more specifically transformers that provide impedance transformations are disclosed. Embodiments of the transformers are arranged to have a plurality of conductors that are connected in series within a conductive path where the conductors form transmission lines. In this manner, embodiments of the transformer can step up or step down voltage and conversely step down or step up current between a low impedance port and a high impedance port. A third port is also provided so that a bias signal can be applied. Embodiments of the transformer may be arranged as a monolithic microwave integrated circuit (MMIC) integrated into a semiconductor substrate. As such, the conductors of the transformer may be strip lines, windings, traces, and/or the like. By forming transmission lines with the conductors, the conductors can provide the appropriate impedance transformations over a relatively wideband and at relatively high frequencies.

FIG. 1 illustrates an exemplary transformer 10. The transformer 10 shown in FIG. 1 includes a plurality of conductors connected in series to one another. In this embodiment, the transformer 10 includes a first conductor 12, a second conductor 14, and a third conductor 16 connected to define a conductive path 18. The first conductor 12, the second conductor 14, and the third conductor 16 are in series within the conductive path 18. The conductive path 18 has a first end 20 and a second end 22 such that the conductive path 18 extends from the first end 20 to the second end 22.

As shown in FIG. 1, the first conductor 12 defines the first end 20. The first conductor 12 extends from the first end 20 to the second conductor 14. Thus, the second conductor 14 is connected in series with the first conductor 12 with respect to the conductive path 18. Furthermore, the first conductor 12 and the second conductor 14 are disposed so as to form a first transmission line 24. With regard to the third conductor 16, the third conductor 16 is connected in series with the second conductor 14 with respect to the conductive path 18. In addition, the second conductor 14 and the third conductor 16 are disposed so as to form a second transmission line 26. The second conductor 14 is thus connected between the first conductor 12 and the third conductor 16. The third conductor 16 defines the second end 22. The third conductor 16 thus extends between the second conductor 14 and the second end 22. As such, the plurality of conductors (i.e., the first conductor 12, the second conductor 14, and the third conductor 16 in the embodiment shown in FIG. 1) are disposed so as to form a plurality of transmission lines (i.e., the first transmission line 24 and the second transmission line 26 in the embodiment shown in FIG. 1).

The transformer 10 shown in FIG. 1 also includes a first port 28 (also referred to as port 1), a second port 30 (also referred to as port 2), and a third port 32 (also referred to as port 3). By connecting the first conductor 12, the second conductor 14, and the third conductor 16 to form the conductive path 18 and providing the first transmission line 24 and the second transmission line 26, the transformer 10 is configured to define a passband between the first port 28 and the second port 30 and is configured to provide an impedance transformation within the passband in which a source impedance presented at the first port 28 is transformed into a load impedance at the second port 30 so that the impedance transformation transforms the source impedance to substantially match the load impedance at the second port 30.

In the transformer 10 shown in FIG. 1, the first conductor 12, the second conductor 14, and the third conductor 16 are arranged so that the transformer 10 is a bias Tee. As such, the first port 28 is a low impedance port, the second port 30 is a high impedance port, and the third port 32 is a bias port. In this embodiment, the first port 28 is coupled so as to provide an intermediary tap to the first transmission line 24. As mentioned above, the first transmission line 24 is formed by the first conductor 12 and the second conductor 14. To provide the intermediary tap to the first transmission line 24, at least a portion of the first conductor 12 is connected between the first port 28 and the second port 30. For example, the first port 28 may be connected to provide an intermediary tap in the first conductor 12 and thus provide an intermediary tap to the first transmission line 24. As such, the first port 28 may be connected to a location of the first conductor 12 that is intermediate to the first end 20 and the second conductor 14. When the first port provides an intermediary tap to the first conductor 12, the portion of the first conductor 12 is connected in series between the first port 28 and the second port 30.

However, in the embodiment shown in FIG. 1, the first port 28 is coupled so as to provide the intermediary tap between the first conductor 12 and the second conductor 14. Thus, in this embodiment, the entire first conductor 12 (not just a portion of the first conductor 12) is connected between the first port 28 and the second port 30. More specifically, to provide the intermediary tap to the first transmission line 24, the first port 28 is connected to a node 34 where the node 34 is provided at the intersection of the first conductor 12 and the second conductor 14.

The second port 30 is coupled to the first conductor 12. More specifically, the second port 30 is coupled to the first end 20 defined by the first conductor 12. This is the first end 20 of the conductive path 18 defined by the first conductor 12, the second conductor 14, and the third conductor 16. In this embodiment, the transformer 10 includes a series capacitive element 38 connected in series between the first end 20 of the first conductor 12 and the second port 30.

The third port 32 is coupled to the third conductor 16. More specifically, the third port 32 is coupled to the second end 22 defined by the third conductor 16. This is the second end 22 of the conductive path 18 defined by the first conductor 12, the second conductor 14, and the third conductor 16. As such, the conductive path 18 is defined so as to extend between the second port 30 and the third port 32. Therefore, the first conductor 12, the second conductor 14, and the third conductor 16 are connected between the second port 30 and the third port 32. Furthermore, the second conductor 14 and the third conductor 16 are connected between the first port 28 and the third port 32 while at least a portion of the first conductor 12 is connected between the first port 28 and the second port 30.

In this embodiment, the transformer 10 includes a bypass capacitive element 40 connected in shunt between the third port 32 and the second end 22 of the third conductor 16. The bypass capacitive element 40 is optional and provided when the transformer 10 is being used to apply a bias voltage and/or bias current. However, if the transformer 10 is not being used as a bias Tee to apply the bias voltage or the bias current, the bypass capacitive element 40 may not be provided. Rather, the third port 32 may simply be shorted directly to ground. Accordingly, the second conductor 14 and the third conductor 16 are connected in series within a path connected in shunt with respect to the first port 28.

The first conductor 12 is connected so that an RF output signal 44 is generated by the first conductor 12 in response to an RF input signal 42 such that the RF output signal 44 propagates through the first conductor 12 in a first current direction to the first port 28 from the second port 30. The RF output signal 44 propagates through the first conductor 12 in a first current direction that is directed to the first end 20 and to the second port 30. After being phase filtered by the series capacitive element 38, the RF output signal 44 is transmitted to the second port 30. With respect to the conductive path 18, the first conductor 12 is connected in series within the conductive path 18. More specifically, the first conductor 12 has the first end 20 and an end 46 oppositely disposed from the first end 20 of the first conductor 12. The first end 20 is coupled to the second port 30 through the series capacitive element 38. The end 46 of the first conductor 12 is connected to the second conductor 14. More specifically, the second conductor 14 has an end 48 and an end 50 oppositely disposed from the end 48. With respect to the conductive path 18, the second conductor 14 is connected in series within the conductive path 18. The end 48 of the second conductor 14 is connected to the end 46 of the first conductor 12. Furthermore, the end 48 is connected to the first port 28. In addition, the end 48 of the second conductor 14 is connected to node 34 and thus to the first port 28.

The first transmission line 24 is configured such that the first conductor 12 and the second conductor 14 are in a bootstrap arrangement so that a voltage drop across the second conductor 14 results in a voltage increase across the first conductor 12 from the first port 28 to the second port 30. As a result, in response to the RF input signal 42, the second conductor 14 is coupled to the first port 28 and in series with the first conductor 12 such that an RF intermediary signal 52 propagates along the conductive path 18. Accordingly, the RF intermediary signal 52 splits off current in the RF output signal 44 so that less current is provided at the second port 30. However, due to the second conductor 14 and the first conductor 12 forming the first transmission line 24, a voltage across the first conductor 12 from the end 46 to the first end 20 increases by an amount based on a voltage drop across the second conductor 14 from the end 48 to the end 50. Assuming that the first transmission line 24 is balanced, the voltage magnitude increase across the first conductor 12 due to the first transmission line 24 from the end 46 to the first end 20 is approximately equal to the voltage drop across the second conductor 14 from the end 48 to the end 50. As a result of the first transmission line 24, the voltage of the RF output signal 44 at the second port 30 is increased with respect to the voltage of the RF input signal 42 at the first port 28. Additionally, a current of the RF output signal 44 is decreased with respect to the RF input signal 42 by a current of the RF intermediary signal 52. As such, the current of the RF output signal 44 is lowered at the second port 30 in comparison to the current of the RF input signal 42 received at the first port 28. Assuming that the first transmission line 24 is balanced, the voltage of the RF output signal 44 at the second port 30 is increased by an amount equal to the voltage across the first conductor 12. The voltage across the first conductor 12 will be equal to a magnitude of the voltage drop across the second conductor 14 Thus, the first transmission line 24 increases a voltage to current ratio from the first port 28 to the second port 30 in order for the transformer 10 to provide the impedance transformation that converts the low impedance LI seen at the first port 28 to the high impedance HI seen at the second port 30.

Furthermore, even if the first transmission line 24 is somewhat unbalanced, a resistance of the first conductor 12 and a resistance of the second conductor 14 can be used to partially dissipate the RF output signal 44 and the RF intermediary signal 52 respectively and still provide the appropriate impedance transformation from the first port 28 to the second impedance seen from the second port 30. Accordingly, the first conductor 12 and the second conductor 14 step up the voltage of the RF output signal 44 and step down the current of the RF output signal 44 in comparison to the voltage of the RF input signal 42 and the current of the RF input signal 42 at the first port 28. In this manner, the transformer 10 is configured to provide the impedance transformation that transforms the low impedance LI at the first port 28 to the high impedance HI at the second port 30.

With respect to the third conductor 16, the third conductor 16 is connected in series within the conductive path 18. The third conductor 16 has an end 58 and the second end 22. The end 50 of the second conductor 14 is connected to the end 58 of the third conductor 16. In this manner, the third conductor 16 is connected in series with the second conductor 14 so that the RF intermediary signal 52 is received from the second conductor 14 along the conductive path 18. The RF intermediary signal 52 propagates across the third conductor 16 from the end 58 to the second end 22 in the second current direction, which is the same current direction that the RF intermediary signal 52 propagated though the second conductor 14. The end 58 of the third conductor 16 is oppositely disposed from the second end 22 of the third conductor 16.

Since the third conductor 16 and the second conductor 14 are connected in series within the conductive path 18, the RF intermediary signal 52 propagates across the second conductor 14 from the end 58 to the second end 22. The bypass capacitive element 40 is connected in shunt to ground and appears approximately as a short circuit to ground to the RF intermediary signal 52. The RF intermediary signal 52 thus propagates in the second current direction (which is the same as the current direction of the RF intermediary signal 60 across the third conductor 16) opposite the first current direction of the RF output signal 44. However, as mentioned above, the third conductor 16 and the second conductor 14 form the second transmission line 26. Thus, in response to the RF intermediary signal 52, the second transmission line 26 is configured to generate an RF intermediary signal 60 from the second end 22 to the end 58 of the third conductor 16 in the first current direction so that there is a voltage increase from the second end 22 to the end 58 that is related to the voltage drop across the second conductor 14 from the end 48 to the end 50. So long as the magnetic field from the second conductor 14 is approximately equal but opposite to the magnetic field from the third conductor 16, a mutual inductance between the second conductor 14 and the third conductor 16 is cancelled, and the second conductor 14 and the third conductor 16 operate as independent conductors. Thus, the RF intermediary signal 52 will be unaffected by the RF intermediary signal 60, since the RF intermediary signal 60 will not be produced, as the magnetic flux between each of the second conductor 14 and the third conductor 16 will cancel. However, if there is a noise signal in the second conductor 14 and/or the third conductor 16, the magnetic fields will be unbalanced and the RF intermediary signal 60 will thus be generated until the noise signal is cancelled and the balance between the magnetic fields is restored. The RF intermediary signal 60 thus propagates in the first current direction while the RF intermediary signal 52 propagates in the opposite second direction. Thus, the RF intermediary signal 60 cancels common mode noise signals of the RF intermediary signal 52, and the second conductor 14 and the third conductor 16 operate as an RF common mode choke.

Assuming that the second transmission line 26 and the first transmission line 24 are both balanced, the first transmission line 24 maintains the voltage drop across the second conductor 14 from the end 48 to the end 50 approximately equal to the voltage increase across the first conductor 12 from the end 46 to the first end 20. Furthermore, assuming that the second transmission line 26 is balanced, the second transmission line 26 transformer will decrease the current of the RF intermediary signal 52 by half since the second conductor 14 and the third conductor 16 are both resistive and inductive in series. Due to magnetic field cancellations that result in mutual inductance cancellations, the RF intermediary signal 52 will cause a voltage drop across the third conductor 16 from the end 58 to the second end 22 approximately equal to the voltage drop across the second conductor 14 from the end 48 to the end 50.

As such, a current ratio of the current magnitude of the RF output signal 44 at the second port 30 with respect to the current magnitude of the RF input signal 42 at the first port 28 is approximately equal to approximately 3/4. Furthermore, a voltage ratio of the voltage magnitude of the RF output signal 44 at the second port 30 with respect to the voltage magnitude of the RF input signal 42 at the first port 28 is approximately equal to approximately 1.5. Accordingly, assuming that the second transmission line 26 and the first transmission line 24 are both balanced, the transformer 10 shown in FIG. 1 is configured to provide an impedance transformation of 2/1 from the first port 28 to the second port 30. For example, a 50 Ohm impedance at the first port 28 will result in a 100 Ohm impedance at the second port 30. As explained in further detail below, the ratio of the impedance transformation is inverted from the second port 30 to the first port 28. For example, a 100 Ohm impedance at the second port 30 will result in a 50 Ohm impedance at the first port 28. In this manner, the transformer 10 is configured to provide the impedance transformation that transforms the low impedance LI at the first port 28 to the high impedance HI at the second port 30.

RF signals are also blocked from the third port 32 by the bypass capacitive element 40 from the third port 32. A bias signal 62, such as a DC voltage and/or DC current, can be applied at the third port 32. The first conductor 12, the second conductor 14, and the third conductor 16 are inductive and allow low frequency signals, such as the bias signal 62 to pass, and thus the bias signal 62 is applied to the first port 28 at the node 34, which is at the end 46 of the first conductor 12. In this manner, the bias signal 62 can be applied to the RF input signal 42 and thus to the RF output signal 44. The series capacitive element 38 blocks the bias signal 62 so that the RF output signal 44 is provided to the second port 30 with the bias signal 62 having been filtered out. Thus only DC components and low frequency components, such as the bias signal 62, are filtered out by the series capacitive element 38. The first transmission line 24 and the second transmission line 26 provide an impedance transformation such that a low impedance LI as seen from the first port 28 is converted to be substantially equal to a high impedance HI as seen from the second port 30.

Figure 1A:
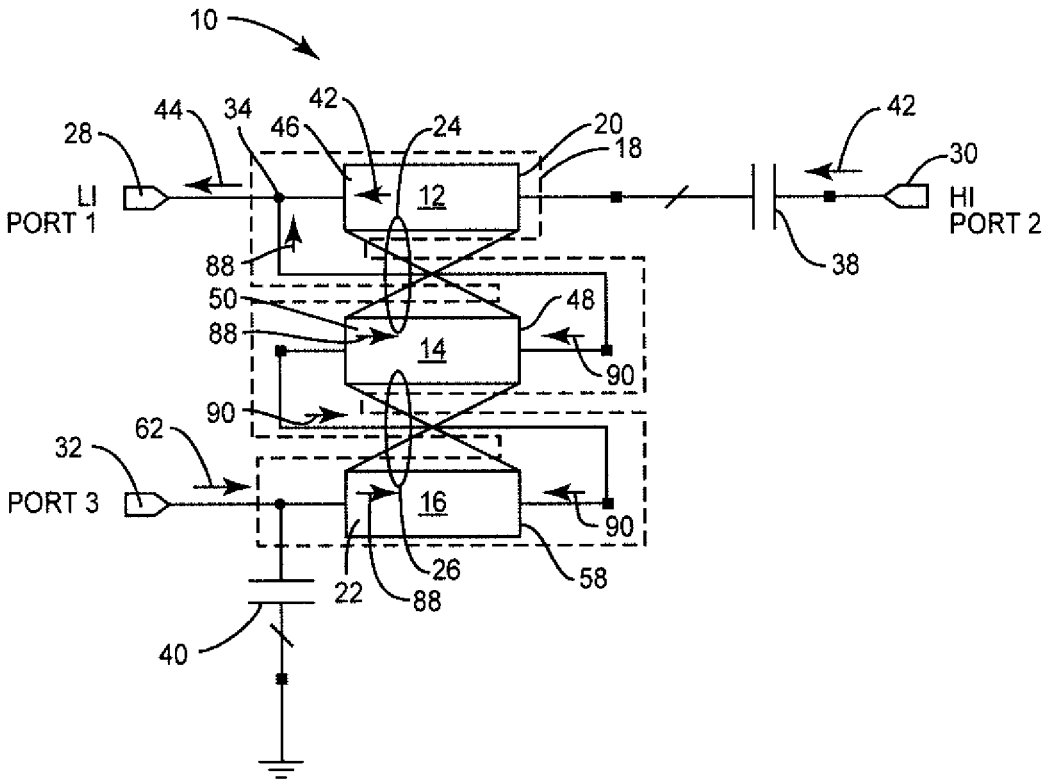
FIG. 1A illustrates the transformer shown in FIG. 1 wherein signaling is shown in the transformer for transforming the high impedance presented at the second port to the low impedance presented at the first port.

Referring to FIG. 1A, the transformer 10 is also symmetrical so as to provide an impedance transformation that transforms the load impedance presented from the second port 30 to the load impedance at the first port 28. More specifically, by providing connecting the first conductor 12, the second conductor 14, and the third conductor 16 to form the conductive path 18 and providing the first transmission line 24 and the second transmission line 26, the transformer 10 is configured to define a passband between the second port 30 and the first port 28 and is configured to provide an impedance transformation within the passband in which a load impedance presented at the second port 30 is transformed into an impedance at the first port 28 that substantially matches the source impedance presented at the first port 28. Accordingly, the transformer 10 is configured to provide an impedance transformation between the second port 30 and the first port 28 that is inverse to the impedance transformation between the first port 28 and the second port 30.

In response to the RF input signal 42 being provided at the second port 30, the first conductor 12 is connected so that the RF input signal 42 propagates in the second current direction from the second port 30 toward the first port 28. Thus, after being phase filtered by the series capacitive element 38, the RF input signal 42 propagates through the first conductor 12 propagates through the first conductor 12 in the second current direction from the first end 20 to the end 46 and then to the node 34. The end 46 is connected to the node 34, which is coupled to the first port 28. The RF input signal 42 results in a voltage drop across the first conductor 12 from the first end 20 to the end 46. As a result, there is a voltage drop from the second port 30 to the first port 28 substantially equal to the voltage drop across the first conductor 12 from the first end 20 to the end 46.

The end 48 of the second conductor 14 is connected to the node 34 and to thus to the end 46 of the first conductor 12 and to the first port 28. Furthermore, as mentioned above, the first conductor 12 and the second conductor 14 form the first transmission line 24. As a result, in response to the RF input signal 42 being received at the second port 30 and propagating through the first conductor 12, the second conductor 14 is configured to generate an RF intermediary signal 88 that propagates in the first current direction from the end 50 to the end 48 of the second conductor 14. This results in a voltage increase across the second conductor 14 from the end 50 to the end 48 substantially equal to the voltage drop across the first conductor 12 from the first end 20 to the end 46. Accordingly, the RF intermediary signal 88 propagates along the conductive path 18. Accordingly, the RF intermediary signal 88 combines with the RF input signal 42 at the node 34 to become the RF output signal 44 at the first port 28. There is thus a current increase at the first port 28 with respect to the second port 30 in response to the RF input signal 42 being received at the second port 30.

With respect to the third conductor 16, the third conductor 16 is connected in series within the conductive path 18 to the second conductor 14. The end 58 of the third conductor 16 is connected to the end 50 of the second conductor 14. This also results in a voltage increase across the third conductor 16 from the second end 22 to the end 50. In this embodiment, the voltage increase across the third conductor 16 is substantially equal to the voltage increase across the second conductor 14 from the end 50 to the end 48 since the second conductor 14 and the third conductor 16 are considered to be substantially identical. Thus, in response to the RF input signal 42 being received at the second port 30 and propagating through the first conductor 12, the voltage at the first port 28 is substantially equal to the voltage increase across the second conductor 14 added to the voltage increase across the first conductor 12. RF intermediary signal 88 also propagates through the third conductor 16 in the first current direction from the second end 22 to the end 58. The RF intermediary signal 88 propagates across the third conductor 16 from the second end 22 to the end 58 in the first current direction, which is the same current direction that the RF intermediary signal 88 propagated though the second conductor 14. The second end 22 of the third conductor 16 is oppositely disposed from the end 58 of the third conductor 16.

As mentioned above, the third conductor 16 and the second conductor 14 form the second transmission line 26. Thus, in response to the RF intermediary signal 88, the second transmission line 26 is configured to generate an RF intermediary signal 90 from the end 48 of the second conductor 14 in the second current direction from the end 48 to the end 50, which would also result in the RF intermediary signal 90 propagating from the end 58 to the second end 22 of the third conductor 16. However, so long as the magnetic field from the second conductor 14 in response to the RF intermediary signal 88 is approximately equal but opposite to the magnetic field generated across the third conductor 16 as a result of the RF intermediary signal 88, a mutual inductance between the second conductor 14 and the third conductor 16 is cancelled, and the second conductor 14 and the third conductor 16 operate as independent conductors. Thus, the RF intermediary signal 88 will be unaffected by the RF intermediary signal 90, since the RF intermediary signal 90 will not be produced, as the magnetic flux between each of the second conductor 14 and the third conductor 16 will cancel. However, if there is a noise signal in the second conductor 14 and/or the third conductor 16, the magnetic fields will be unbalanced and the RF intermediary signal 90 will thus be generated until the noise signal is cancelled and the balance between the magnetic fields is restored. The RF intermediary signal 90 thus propagates in the second current direction while the RF intermediary signal 88 propagates in the opposite first current direction. Thus, the RF intermediary signal 90 cancels common mode noise signals of the RF intermediary signal 88 and the second conductor 14 and the third conductor 16 operate as an RF common mode choke.

Assuming that the second transmission line 26 and the first transmission line 24 are both balanced, the first transmission line 24 maintains the voltage drop across the second conductor 14 from the end 50 to the end 48 approximately equal to the voltage increase across the first conductor 12 from the first end 20 to the end 46, and thus the voltage increase across the third conductor 16 is substantially equal to the voltage increase across the second conductor 14. Thus, there is a voltage decrease from the second port 30 to the first port 28 where the voltage ratio is about 2/3. Furthermore, the first transmission line 24 will generate the RF intermediary signal 88 so as to increase the current of the RF output signal 44 at the first port 28. Assuming that the second transmission line 26 and the first transmission line 24 are both balanced, the second conductor 14 and the third conductor 16 are both resistive and inductive in series. Due to magnetic field cancellations that result in mutual inductance cancellations, the RF intermediary signal 88 will result in a current increase of the RF output signal 44 at the first port 28 of approximately equal to 1/3 of the current of the RF input signal 42. Thus, the current ratio from the second port 30 to the first port 28 is 4/3. As a result, the impedance ratio from the second port 30 to the first port 28 is 1/2. Accordingly, within the passband, the transformer 10 is configured for impedance transformation that transforms the high impedance HI at the second port 30 to half its value at the first port 28.

The transformer 10 may be formed as a MMIC integrated into a semiconductor substrate. Thus, the conductors 12, 14, 16 may each be provided in any type of wave guide within the MMIC such as a trace, a winding, a strip line and/or the like. The first transmission line 24 and the second transmission line 26 may be provided through edge radiative coupling or broadside radiative coupling between the conductors 12, 14, 16. One advantage of coupling the conductors 12, 14, 16 of the arrangement of the transformer 10 shown in FIG. 1 is that the arrangement can get significantly greater bandwidth and less insertion loss, as the conductors 12, 14, 16, enable lines to be made shorter and wider in comparison to other prior art transformer arrangements such as a Ruthroff transformer.

Figure 2:
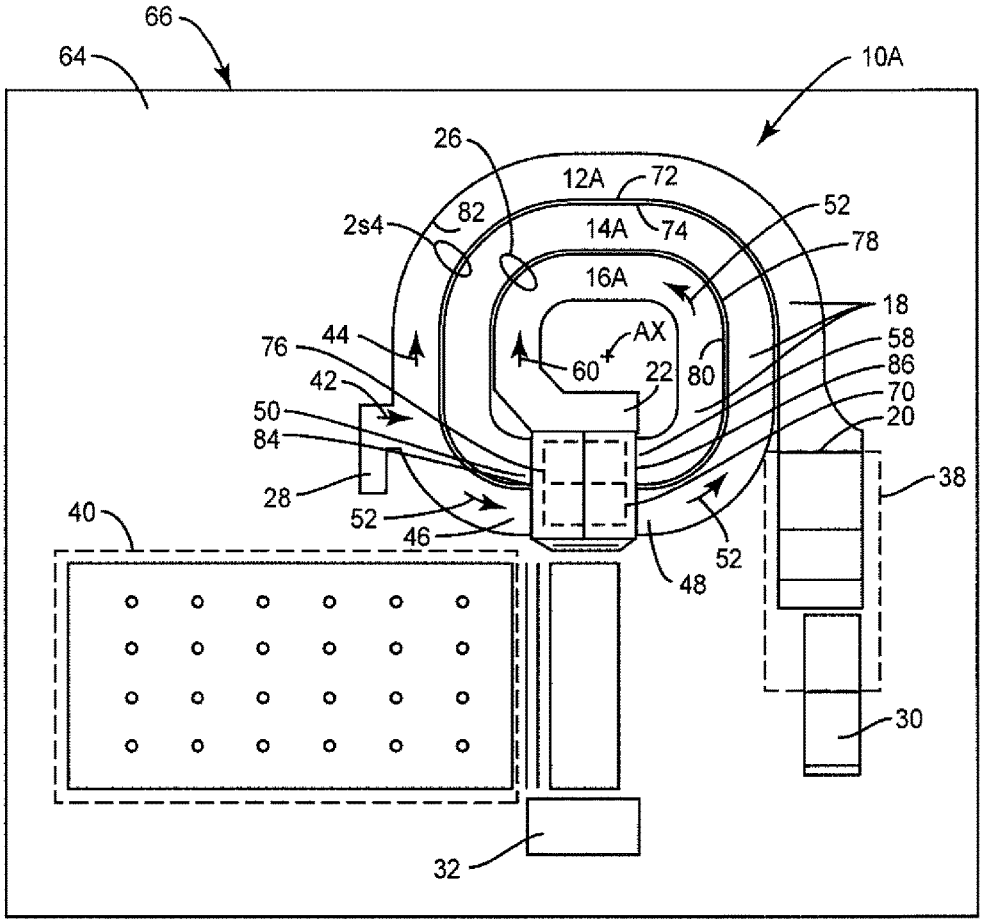
FIG. 2 illustrates one implementation of the transformer shown in FIG. 1 where the conductors are provided as windings and the transformer includes a series capacitive element and a bypass capacitive element.

FIG. 2 illustrates a transformer 10A, which is one embodiment of the transformer 10 shown in FIG. 1 and in FIG. 1A. The transformer 10 shown in FIG. 2 is formed as a MMIC and includes a plurality of conductors connected in series to one another. In this embodiment, the plurality of conductors are a plurality of windings that form a coil. For example, the plurality of windings are formed as traces formed a surface 64 of a semiconductor substrate 66. Thus, in this embodiment, the plurality of windings are each planar windings that form a planar coil.

The first conductor 12 shown in FIG. 1 and FIG. 1A is provided as a first winding 12A in FIG. 2, which is an outermost winding of the planar coil. The second conductor 14 shown in FIG. 1 is provided as a second winding 14A in FIG. 2, which is an intermediary winding of the planar coil.

Finally, third conductor 16 shown in FIG. 1 is provided as a third winding 16A in FIG. 2, which is an innermost winding of the planar coil. Thus, the first winding 12A, the second winding 14A, and the third winding 16A are connected in series to form the conductive path 18 from the first end 20 to the second end 22. The first winding 12A, the second winding 14A, and the third winding 16A are each wound about a common axis AX to form the planar coil. The first winding 12A is the outermost winding and is thus wound about the common axis AX so as to have the largest perimeter. The second winding 14A is the intermediary winding and is thus wound about the common axis AX between the first winding 12A and the third winding 16A. As such, the second winding 14A has a perimeter smaller than the first winding 12A but greater than a perimeter of the third winding 16A. The third winding 16A is the innermost winding and is thus wound about the common axis AX so as to have the smallest perimeter.

As shown in FIG. 2, the first winding 12A defines the first end 20, which is the outer end since the first winding 12A is the outermost winding and the end 46. The first winding 12A extends from the first end 20 to the end 46, which is the end of the first winding 12A oppositely disposed from the first end 20. The second winding 14A is connected in series with the first winding 12A. In this embodiment, a conductive bridge 70 is formed by metallic components within the semiconductor substrate 66 so as to connect the end 46 of the first winding 12A to the end 48 of the second winding 14A. Furthermore, the first winding 12A and the second winding 14A are disposed so as to form an embodiment of the first transmission line 24. In this embodiment, the first winding 12A and the second winding 14A are edge coupled to form an embodiment of the first transmission line 24. Accordingly, the first winding 12A and the second winding 14A operate in a waveguide mode such that a radiated magnetic and/or electric field from lateral edges of the first winding 12A and the second winding 14A couple the first winding 12A and the second winding 14A and provide the first transmission line 24. More specifically, an inner lateral edge 72 of the first winding 12A is field coupled to an outermost lateral edge 74 of the second winding 14A.

With regard to the third winding 16A, the third winding 16A is connected in series with the second winding 14A. More specifically, a bridge 76 is formed by metallic components within the semiconductor substrate 66 to connect the end 50 of the second winding 14A to the end 58 of the third winding 16A. The second winding 14A is thus connected between the first winding 12A and the third winding 16A. The third winding 16A thus extends between the second winding 14A and the second end 22, which is defined by the third winding 16A.

In addition, the second winding 14A and the third winding 16A are disposed so as to form an embodiment of the second transmission line 26. The second winding 14A and the third winding 16A are disposed so as to form an embodiment of the second transmission line 26. In this embodiment, second winding 14A and the third winding 16A are edge coupled to form an embodiment of the second transmission line 26. Accordingly, the second winding 14A and the third winding 16A operate in a waveguide mode such that a radiated magnetic and/or electric field from lateral edges of the second winding 14A and the third winding 16A couple the second winding 14A and the third winding 16A and provide the second transmission line 26. More specifically, an inner lateral edge 78 of the second winding 14A is field coupled to an outermost lateral edge 80 of the third winding 16A.

The transformer 10A shown in FIG. 2 also includes embodiments of the first port 28 (also referred to a port 1), the second port 30 (also referred to as port 2), and the third port 32 (also referred to as port 3). By connecting the first winding 12A, the second winding 14A, and the third winding 16A in series with respect to the conductive path 18 and by providing the first transmission line 24 and the second transmission line 26, the transformer 10A is configured to define a passband between the first port 28 and the second port 30 and is configured to provide an impedance transformation in which a source impedance presented at the first port 28 is transformed into an impedance at the second port 30 that substantially matches a load impedance presented at the second port 30. As such, the plurality of conductors (i.e., the first winding 12A, the second winding 14A, and the third winding 16A in the embodiment shown in FIG. 2) are disposed so as to form a plurality of transmission lines (i.e., the first transmission line 24 and the second transmission line 26 in the embodiment shown in FIG. 2).

In the transformer 10A shown in FIG. 2, the first winding 12A, the second winding 14A, and the third winding 16A are arranged so that the transformer 10A is a bias Tee. As such, the first port 28 is a low impedance port, the second port 30 is a high impedance port, and the third port 32 is a bias port. The first port 28 is coupled so as to provide an intermediary tap to the first transmission line 24. As mentioned above, the first transmission line 24 is formed by the first winding 12A and the second winding 14A.

The second port 30 is coupled to the first winding 12A. More specifically, the second port 30 is coupled to the first end 20 defined by the first winding 12A. This is the first end 20 of the conductive path 18 defined by the first winding 12A, the second winding 14A, and the third winding 16A. In this embodiment, the transformer 10A includes an embodiment of the series capacitive element 38 connected in series between the first end 20 of the first winding 12A and the second port 30 to help increase performance at a low frequency edge of the passband defined by the transformer 10A.

The third port 32 is coupled to the third winding 16A. More specifically, the third port 32 is coupled to the second end 22 defined by the third winding 16A. This is the second end 22 of the conductive path 18 defined by the first winding 12A, the second winding 14A, and the third winding 16A. As such, the conductive path 18 is defined so as to extend between the second port 30 and the third port 32. Therefore, the first winding 12A, the second winding 14A, and the third winding 16A are connected between the second port 30 and the third port 32. Furthermore, the second winding 14A and the third winding 16A are connected between the first port 28 and the third port 32 while a portion of the first winding 12A is connected between the first port 28 and the second port 30.

The first port 28 is provided at an outermost lateral edge 82 of the first winding 12A, and the second port 30 is coupled to the first end 20 so that the RF output signal 44 propagates through the first winding 12A in a clockwise current direction in response to the RF input signal 42 being applied to the first port 28. In this manner, the RF output signal 44 is generated by the first winding 12A in response to the RF input signal 42 such that the RF output signal 44 propagates through the first winding 12A in the clockwise direction from the first port 28 toward the second port 30. After being filtered by the bypass capacitive element 40, the RF output signal 44 is transmitted to the second port 30 and then from the second port to downstream circuitry (not shown). Since the end 46 of the first winding 12A and the end 48 of the second winding 14A connect the first winding 12A and the second winding 14A in series, the RF intermediary signal 52 propagates in a counter clockwise direction from the end 48 to the end 50. As a result, the second winding 14A is coupled to the second winding 14A and in series with the first winding 12A such that the RF intermediary signal 52 propagates in the counterclockwise direction from the end 48 to the end 50 in response to the RF input signal 42 being applied to the first port 28. The RF intermediary signal 52 thus propagates in the counterclockwise direction opposite the clockwise direction of the RF output signal 44.

The first transmission line 24 is configured such that the first winding 12A and the second winding 14A are in a bootstrap arrangement so that a voltage drop across the second winding 14A results in a voltage increase across the first winding 12A from the first port 28 to the second port 30. Assuming that the first transmission line 24 is balanced, the voltage increase across the first winding 12A from the first port 28 to the second port 30 will be equal to approximately the voltage drop across the second winding 14A from the end 48 to the end 50. The RF intermediary signal 52 will have a current that is split off from the RF input signal 42 at the first port 28. As such, a voltage of the RF output signal 44 is stepped up, while a current of the RF output signal 44 is stepped down. Furthermore, even if the first transmission line 24 is somewhat unbalanced, the first transmission line 24 allows some power to be dissipated through a resistance of the second winding 14A and thus maintains appropriate impedance matching between the first port 28 and the second port 30. The bias signal 62 is applied to the RF output signal 44 since the first winding 12A, the second winding 14A, and the third winding 16A are inductive and thus do not block DC signals and/or other low frequency signals such as the bias signal 62.

The second winding 14A and the third winding 16A are connected in series within a path connected in shunt with respect to the first port 28. With respect to the third winding 16A, the third winding 16A is connected in series within the conductive path 18. The third winding 16A has the end 58 and the second end 22. The end 50 of the second winding 14A is connected to the end 58 of the third winding 16A. In this manner, the third winding 16A is connected in series with the second winding 14A so that the RF intermediary signal 52 is received from the second winding 14A along the conductive path 18. The RF intermediary signal 52 propagates across the third winding 16A from the end 58 to the second end 22 in the second current direction, which is the same current direction that the RF intermediary signal 52 propagated though the second winding 14A. The end 58 of the third winding 16A is oppositely disposed from the second end 22 of the third winding 16A.

Since the third winding 16A and the second winding 14A are connected in series within the conductive path 18, the RF intermediary signal 52 propagates across the second winding 14A from the end 58 to the second end 22. The bypass capacitive element 40 is connected in shunt to ground and appears approximately as a short circuit to ground to the RF intermediary signal 52. Thus, the second winding 14A and the third winding 16A are connected in series within a path connected in shunt with respect to the first port 28. With respect to the third winding 16A, the RF intermediary signal 52 thus propagates in the second current direction (which is the same as the current direction of the RF intermediary signal 60 across the third winding 16A) opposite the first current direction of the RF output signal 44. However, as mentioned above, the third winding 16A and the second winding 14A form the second transmission line 26. Thus, in response to the RF intermediary signal 52, the second transmission line 26 is configured to generate an RF intermediary signal 60 from the second end 22 to the end 58 of the third winding 16A in the first current direction so that there is a voltage increase from the second end 22 to the end 58 that is related to the voltage drop across the second winding 14A from the end 48 to the end 50. So long as the magnetic field from the second winding 14A is approximately equal but opposite to the magnetic field from the third winding 16A, a mutual inductance between the second winding 14A and the third winding 16A is cancelled, and the second winding 14A and the third winding 16A operate as independent conductors. Thus, the RF intermediary signal 52 will be unaffected by the RF intermediary signal 60, since the RF intermediary signal 60 will not be produced, as the magnetic flux between each of the second winding 14A and the third winding 16A will cancel. However, if there is a noise signal in the second winding 14A and/or the third winding 16A, the magnetic fields will be unbalanced, and the RF intermediary signal 60 will thus be generated until the noise signal is cancelled and the balance between the magnetic fields is restored. The RF intermediary signal 60 thus propagates in the first current direction while the RF intermediary signal 52 propagates in the opposite second direction. Thus, the RF intermediary signal 60 cancels common mode noise signals of the RF intermediary signal 52 and the second winding 14A and the third winding 16A operate as an RF common mode choke.

Assuming that the second transmission line 26 and the first transmission line 24 are both balanced, the first transmission line 24 maintains the voltage drop across the second winding 14A from the end 48 to the end 50 approximately equal to the voltage increase across the first winding 12A from the end 46 to the first end 20. Furthermore, assuming that the second transmission line 26 is balanced, the second transmission line 26 transformer will decrease the current of the RF intermediary signal 52 by half since the second winding 14A and the third winding 16A are both resistive and inductive in series. Due to magnetic field cancellations that result in mutual inductance cancellations, the RF intermediary signal 52 will cause a voltage drop across the third winding 16A from the end 58 to the second end 22 approximately equal to the voltage drop across the second winding 14A from the end 48 to the end 50.

As such, a current ratio of the current magnitude of the RF output signal 44 at the second port 30 with respect to the current magnitude of the RF input signal 42 at the first port 28 is approximately equal to approximately 3/4. Furthermore, a voltage ratio of the voltage magnitude of the RF output signal 44 at the second port 30 with respect to the voltage magnitude of the RF input signal 42 at the first port 28 is approximately equal to approximately 1.5. Accordingly, assuming that the second transmission line 26 and the first transmission line 24 are both balanced, the transformer 10A shown in FIG. 2 is configured to provide an impedance transformation of approximately of 2/1 from the first port 28 to the second port 30. For example, a 28 Ohm impedance at the first port 28 will result in approximately a 50 Ohm impedance at the second port 30. As explained in further detail below, the ratio of the impedance transformation is inverted from the second port 30 to the first port 28. For example, a 50 Ohm impedance at the second port 30 will result in approximately a 28 Ohm impedance at the first port 28. In this manner, the transformer 10A is configured to provide the impedance transformation that transforms the low impedance LI at the first port 28 to the high impedance HI at the second port 30.

RF signals are also blocked from the third port 32 by the bypass capacitive element 40 from the third port 32. A bias signal 62, such as a DC voltage and/or DC current, can be applied at the third port 32. The first winding 12A, the second winding 14A, and the third winding 16A are inductive and allow low frequency signals, such as the bias signal 62, to pass and thus the bias signal 62 is applied to the first port 28 at the node 34, which is at the end 46 of the first winding 12A. In this manner, the bias signal 62 can be applied to the RF input signal 42 and thus to the RF output signal 44. The series capacitive element 38 blocks the bias signal 62 so that the RF output signal 44 is provided to the second port 30 with the bias signal 62 having been filtered out. Thus only DC components and low frequency components, such as the bias signal 62, are filtered out by the series capacitive element 38. The first transmission line 24 and the second transmission line 26 provide an impedance transformation such that a low impedance LI as seen from the first port 28 is converted to be substantially equal to a high impedance HI as seen from the second port 30.

The bypass capacitive element 40 is provided as a Metal Insulator Metal (MIM) capacitor having a grounding configuration, where the bypass capacitive element 40 is formed from a top plate, and dielectric vias are provided that connect from the top plate to a grounding plate so that at least a portion of the grounding plate forms a bottom plate of the capacitive element. Microstrip line 84 and microstrip line 86 connect to the second end 22 and are bridged into lower metal layers within the semiconductor substrate 66 that provide a shunted connection to the bypass capacitive element 40 and then connect by a bridge to the third port 32, which in this example is provided by a conductive pad.

In first exemplary implementation shown in FIG. 2, adjacent pairs of the windings 12A, 14A, and 16A are spaced approximately 11 μm apart. Furthermore, each of the windings 12A, 14A, 16A has a width of approximately 80 μm wide. The transformer 10A is built with the semiconductor substrate 66 being a 4 millimeter Silicon Carbide (SiC) substrate formed using QGaN15 process. The transformer 10A of this first implementation matches to approximately 28 Ohms at the first port 28 with approximately 50 Ohms at the second port 30 has a size of approximately 1200 μm×1400 μm.

Figure 3:
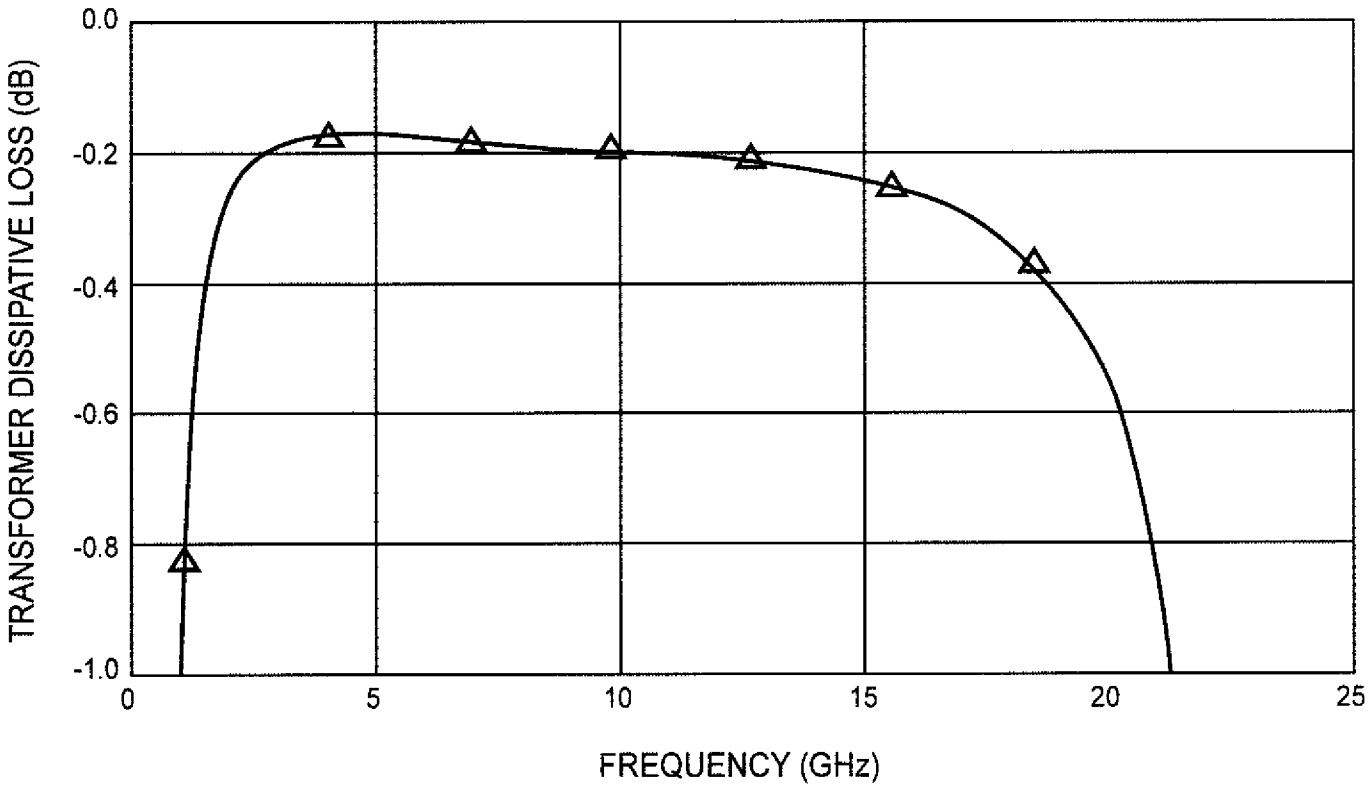
FIG. 3 illustrates a dissipative loss of the transformer shown in FIG. 2.

FIG. 3 illustrates a dissipative loss of the first exemplary implementation of the transformer 10A just described. The transformer 10A has been optimized for use for RF input signals (like the RF input signal 42) within a frequency range of approximately 7 GHz to approximately 18 GHz. As shown in FIG. 3, the dissipative loss of the first exemplary implementation of the transformer 10A is relatively low throughout the frequency range. For example, the first exemplary implementation of the transformer 10A has less than 0.4 dB of insertion loss at a frequency as high as 18 GHz.

Figure 4:
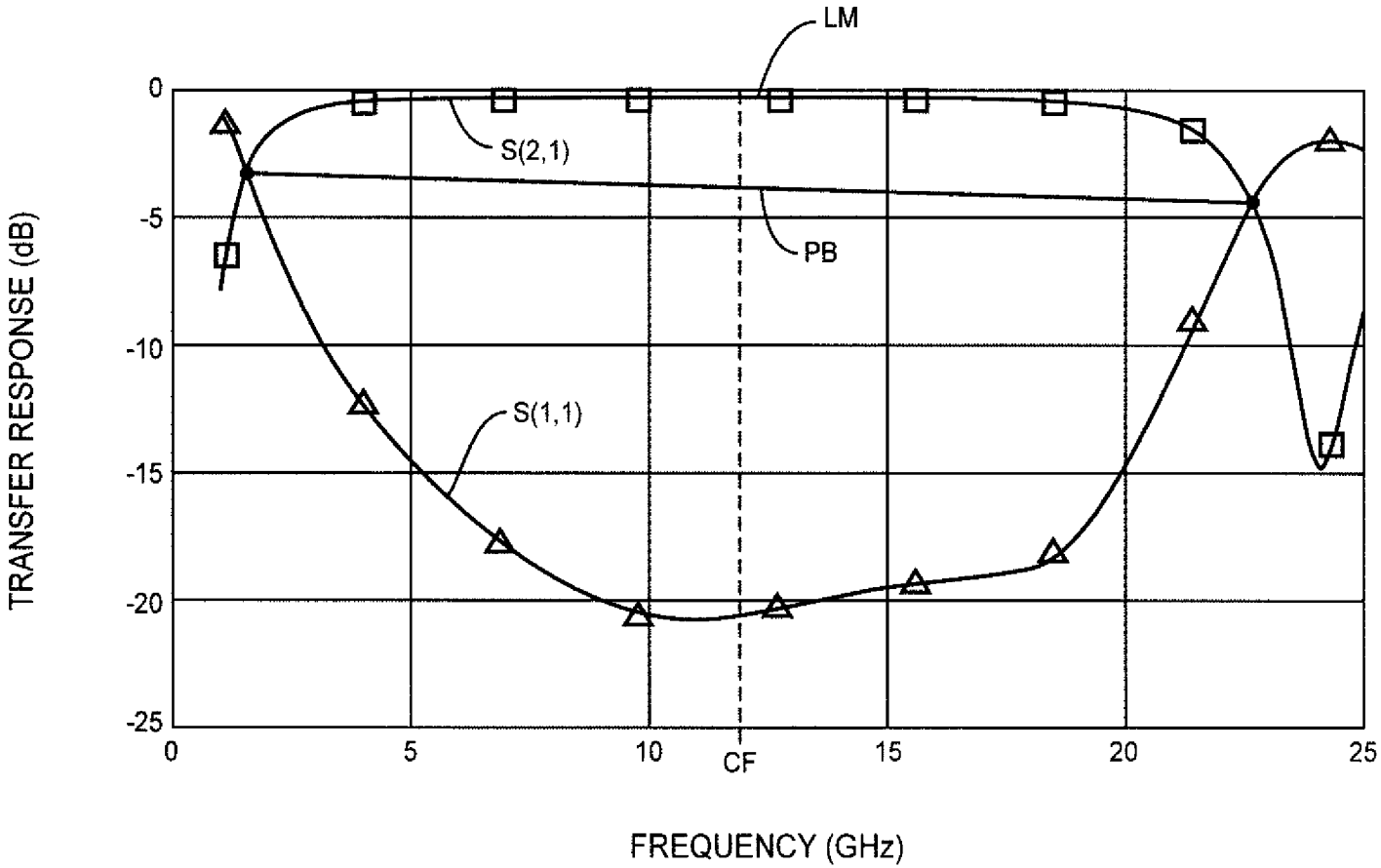
FIG. 4 illustrates transfer responses of the transformer shown in FIG. 2.

FIG. 4 illustrates transfer responses of the first exemplary implementation of the transformer 10A. More specifically, a transfer response S(2,1) is shown in FIG. 4, which is the transfer function between the first port 28 (i.e., port 1 in FIG. 2) and the second port 30 (i.e., port 2 in FIG. 2) when the RF input signal 42 is received at the first port 28 (shown in FIG. 2) and the RF output signal 44 (shown in FIG. 2) is output from the second port 30. A transfer response S(1,1) is also shown in FIG. 4, which is the transfer function that describes the amount of power reflected at the first port 28 (i.e., port 1 in FIG. 2) when the RF input signal 42 is received at the first port 28 (shown in FIG. 2). The S(1,1) response thus describes a degree of matching based on the impedance transformation provided by the transformer 10A in transforming the 50 Ohms presented at the second port 30 to the 28 Ohms presented at the first port 28.

As shown in FIG. 4, the S(2,1) response defines a passband PB. The passband PB is defined by a center frequency CF and by one or more local maxima LM. More specifically, the first passband PB is defined by the portion of the S(2,1) transfer response at the three dB locations lower than the local maxima LM or the average of the local maxima. In this case, there is only one local maxima LM, and thus the first passband PB is defined as extending between the three dB locations that are lower than the local maxima LB, since the average value of the single local maxima LM is simply the value of the local maxima LM. The passband PB is thus from about 2 Ghz to about 22 GHz. Note furthermore that the S(1,1) transfer response shows that reflections are kept well below 15 dB reflections between 7 Ghz to 18 Ghz within the passband PB. Thus, transformer 10A (shown in FIG. 2) has been optimized for use for RF input signals (like the RF input signal 42) within a frequency range of approximately 7 GHz to approximately 18 GHz.

Figure 5:
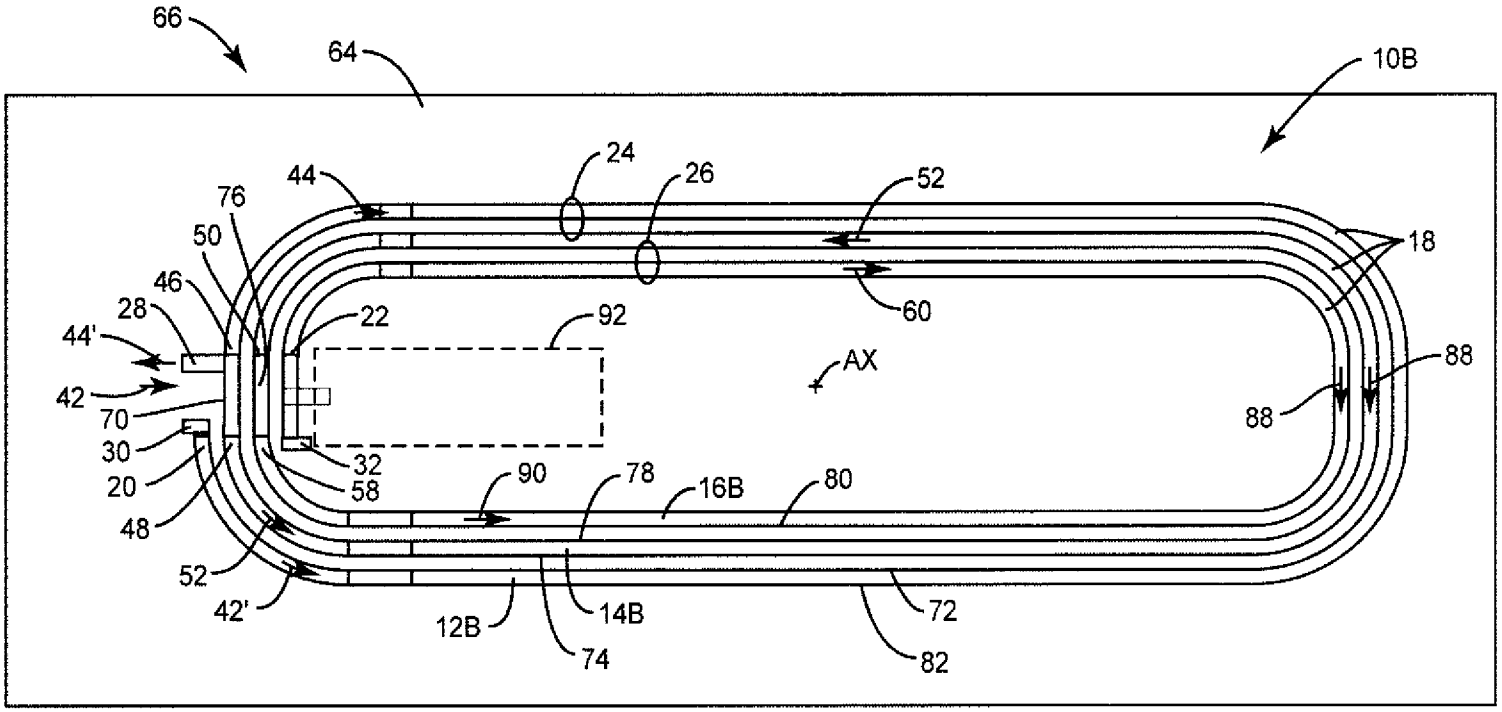
FIG. 5 illustrates another implementation of the transformer shown in FIG. 1 where the conductors are also provided as windings but the transformer does not include a bypass capacitive element and does not include a series capacitive element.

FIG. 5 illustrates a transformer 10B, which is one embodiment of the transformer 10 shown in FIG. 1 and in FIG. 1A. The transformer 10B shown in FIG. 5 is formed as a MMIC and includes a plurality of conductors connected in series to one another. In this embodiment, the plurality of conductors are a plurality of windings that form a coil. For example, the plurality of windings are formed as traces formed on the surface 64 of the semiconductor substrate 66. Thus, in this embodiment, the plurality of windings are each planar windings that form a planar coil. In this example, the plurality of windings are formed as traces formed on the surface 64 of the semiconductor substrate 66. Thus, in this embodiment, the plurality of windings are each planar windings that form a planar coil.

The first conductor 12 shown in FIG. 1 is provided as a first winding 12B in FIG. 5, which is an outermost winding of the planar coil. The second conductor 14 shown in FIG. 1 is provided as a second winding 14B in FIG. 5, which is an intermediary winding of the planar coil. Finally, third conductor 16 shown in FIG. 1 is provided as a third winding 16B in FIG. 5, which is an innermost winding of the planar coil. Thus, the first winding 12B, the second winding 14B, and the third winding 16B are connected in series to form the conductive path 18 from the first end 20 to the second end 22. The first winding 12B, the second winding 14B, and the third winding 16B are each wound about a common axis AX to form the planar coil. The first winding 12B is the outermost winding and is thus wound about the common axis AX so as to have the largest perimeter. The second winding 14B is the intermediary winding and is thus wound about the common axis AX between the first winding 12B and the third winding 16B. As such, the second winding 14B has a perimeter smaller than the first winding 12B but greater than a perimeter of the third winding 16B. The third winding 16B is the innermost winding and is thus wound about the common axis AX so as to have the smallest perimeter.

As shown in FIG. 5, the first winding 12B defines the first end 20, which is the outer end since the first winding 12B is the outermost winding and the end 46. The first winding 12B extends from the first end 20 to the end 46, which is the end of the first winding 12B oppositely disposed from the first end 20. The second winding 14B is connected in series with the first winding 12B. In this embodiment, the conductive bridge 70 is formed by metallic components within the semiconductor substrate 66 so as to connect the end 46 of the first winding 12B to the end 48 of the second winding 14B. Furthermore, the first winding 12B and the second winding 14B are disposed so as to form an embodiment of the first transmission line 24. In this embodiment, the first winding 12B and the second winding 14B are edge coupled to form an embodiment of the first transmission line 24. Accordingly, the first winding 12B and the second winding 14B operate in a waveguide mode such that a radiated magnetic and/or electric field from lateral edges of the first winding 12B and the second winding 14B couple the first winding 12B and the second winding 14B and provide the first transmission line 24. More specifically, an inner lateral edge 72 of the first winding 12B is field coupled to the outermost lateral edge 74 of the second winding 14B.

With regard to the third winding 16B, the third winding 16B is connected in series with the second winding 14B. More specifically, the bridge 76 is formed by metallic components within the semiconductor substrate 66 to connect the end 50 of the second winding 14B to the end 58 of the third winding 16B. The second winding 14B is thus connected between the first winding 12B and the third winding 16B. The third winding 16B thus extends between the second winding 14B and the second end 22, which is defined by the third winding 16B.

In addition, the second winding 14B and the third winding 16B are disposed so as to form an embodiment of the second transmission line 26. The second winding 14B and the third winding 16B are disposed so as to form an embodiment of the second transmission line 26. In this embodiment, second winding 14B and the third winding 16B are edge coupled to form an embodiment of the second transmission line 26. Accordingly, the second winding 14B and the third winding 16B operate in a waveguide mode such that a radiated magnetic and/or electric field from lateral edges of the second winding 14B and the third winding 16B couple the second winding 14B and the third winding 16B and provide the second transmission line 26. More specifically, an inner lateral edge 78 of the second winding 14B is field coupled to an outermost lateral edge 80 of the third winding 16B.

The transformer 10B shown in FIG. 5 also includes embodiments of the first port 28 (also referred to a port 1), the second port 30 (also referred to as port 2), and the third port 32 (also referred to as port 3). By providing connecting the first winding 12B, the second winding 14B, and the third winding 16B in series with respect to the conductive path 18 and by providing the first transmission line 24 and the second transmission line 26, the transformer 10B is configured to define a passband between the first port 28 and the second port 30 and is configured to provide an impedance transformation in which a source impedance presented at the first port 28 is transformed into a source impedance at the second port 30 that substantially matches a load impedance presented at the second port 30. As such, the plurality of conductors (i.e., the first winding 12B, the second winding 14B, and the third winding 16B in the embodiment shown in FIG. 5) are disposed so as to form a plurality of transmission lines (i.e., the first transmission line 24 and the second transmission line 26 in the embodiment shown in FIG. 5).

In the transformer 10B shown in FIG. 5, the first winding 12B, the second winding 14B, and the third winding 16B are arranged so that the transformer 10B is a trifilar transformer. As such, the first port 28 is a low impedance port, the second port 30 is a high impedance port, and the third port 32 is a bias port. The first port 28 is coupled so as to provide an intermediary tap to the first transmission line 24. As mentioned above, the first transmission line 24 is formed by the first winding 12B and the second winding 14B.

The second port 30 is coupled to the first winding 12B. More specifically, the second port 30 is coupled to the first end 20 defined by the first winding 12B. This is the first end 20 of the conductive path 18 defined by the first winding 12B, the second winding 14B, and the third winding 16B. In this embodiment, the first end 20 of the first winding 12B and the second port 30 are directly connected without a series capacitive element (i.e., the series capacitive element 38 shown in FIGS. 1, 1A, and 2.).

The third port 32 is coupled to the third winding 16B. More specifically, the third port 32 is coupled to the second end 22 defined by the third winding 16B. This is the second end 22 of the conductive path 18 defined by the first winding 12B, the second winding 14B, and the third winding 16B. As such, the conductive path 18 is defined so as to extend between the second port 30 and the third port 32. Therefore, the first winding 12B, the second winding 14B, and the third winding 16B are connected between the second port 30 and the third port 32. Furthermore, the second winding 14B and the third winding 16B are connected between the first port 28 and the third port 32, while a portion of the first winding 12B is connected between the first port 28 and the second port 30.

The first port 28 is provided at the outermost lateral edge 82 of the first winding 12B, and the second port 30 is coupled to the first end 20 so that the RF output signal 44 propagates through the first winding 12B in a clockwise current direction in response to the RF input signal 42 being applied to the first port 28. In this manner, the RF output signal 44 is generated by the first winding 12B in response to the RF input signal 42 such that the RF output signal 44 propagates through the first winding 12B in the clockwise direction from the first port 28 toward the second port 30. After being filtered by the bypass capacitive element 40, the RF output signal 44 is transmitted to the second port 30 and then from the second port to downstream circuitry (not shown).

In this embodiment, the first port 28 is connected at the end 46 of the first winding 12B and thus is connect between the first winding 12B and the second winding 14B to provide the intermediary tap to the first transmission line 24. As such, the entire first winding 12B shown in FIG. 5 is connected between the first port 28 and the second port 30. Since the end 46 of the first winding 12B and the end 48 of the second winding 14B connect the first winding 12B and the second winding 14B in series, the RF intermediary signal 52 propagates in a counterclockwise direction from the end 48 to the end 50. As a result, the second winding 14B is coupled to the second winding 14B and in series with the first winding 12B such that the RF intermediary signal 52 propagates in the counterclockwise direction from the end 48 to the end 50 in response to the RF input signal 42 being applied to the first port 28. The RF intermediary signal 52 thus propagates in the counterclockwise direction opposite the clockwise direction of the RF output signal 44.

The first transmission line 24 is configured such that the first winding 12B and the second winding 14B are in a bootstrap arrangement so that a voltage drop across the second winding 14B results in a voltage increase across the first winding 12B from the first port 28 to the second port 30. Assuming that the first transmission line 24 is balanced, the voltage increase across the first winding 12B from the first port 28 to the second port 30 will be equal to approximately the voltage drop across the second winding 14B from the end 48 to the end 50. The RF intermediary signal 52 will have a current that is split off from the RF input signal 42 at the first port 28. As such, a voltage of the RF output signal 44 is stepped up, while a current of the RF output signal 44 is stepped down. Furthermore, even if the first transmission line 24 is somewhat unbalanced, the first transmission line 24 allows some power to be dissipated through a resistance of the second winding 14B and thus maintains appropriate impedance matching between the first port 28 and the second port 30. The bias signal 62 is applied to the RF output signal 44 since the first winding 12B, the second winding 14B, and the third winding 16B are inductive and thus do not block DC signals and/or other low frequency signals such as the bias signal 62.

With respect to the third winding 16B, the third winding 16B is connected in series within the conductive path 18. The third winding 16B has an end 58 and the second end 22. The end 50 of the second winding 14B is connected to the end 58 of the third winding 16B. In this manner, the third winding 16B is connected in series with the second winding 14B so that the RF intermediary signal 52 is received from the second winding 14B along the conductive path 18. The RF intermediary signal 60 propagates across the third winding 16B from the end 58 to the second end 22 in the second current direction, which is the same current direction that the RF intermediary signal 52 propagated though the second winding 14B. The end 58 of the third winding 16B is oppositely disposed from the second end 22 of the third winding 16B.

Since the third winding 16B and the second winding 14B are connected in series within the conductive path 18, the RF intermediary signal 52 propagates across the second winding 14B from the end 58 to the second end 22. The bypass capacitive element 40 is connected in shunt to ground and appears approximately as a short circuit to ground to the RF intermediary signal 52. The RF intermediary signal 52 thus propagates in the second current direction (which is the same as the current direction of the RF intermediary signal 60 across the third winding 16B) opposite the first current direction of the RF output signal 44. However, as mentioned above, the third winding 16B and the second winding 14B form the second transmission line 26. Thus, in response to the RF intermediary signal 52, the second transmission line 26 is configured to generate an RF intermediary signal 60 from the second end 22 to the end 58 of the third winding 16B in the first current direction so that there is a voltage increase from the second end 22 to the end 58 that is related to the voltage drop across the second winding 14B from the end 48 to the end 50. So long as the magnetic field from the second winding 14B is approximately equal but opposite to the magnetic field from the third winding 16B, a mutual inductance between the second winding 14B and the third winding 16B is cancelled, and the second winding 14B and the third winding 16B operate as independent conductors. Thus, the RF intermediary signal 52 will be unaffected by the RF intermediary signal 60, since the RF intermediary signal 60 will not be produced, as the magnetic flux between each of the second winding 14B and the third winding 16B will cancel. However, if there is a noise signal in the second winding 14B and/or the third winding 16B, the magnetic fields will be unbalanced, and the RF intermediary signal 60 will thus be generated until the noise signal is cancelled and the balance between the magnetic fields is restored. The RF intermediary signal 60 thus propagates in the clockwise current direction while the RF intermediary signal 52 propagates in the opposite counterclockwise current direction. Thus, the RF intermediary signal 60 cancels common mode noise signals of the RF intermediary signal 52, and the second winding 14B and the third winding 16B operate as an RF common mode choke.

Assuming that the second transmission line 26 and the first transmission line 24 are both balanced, the first transmission line 24 maintains the voltage drop across the second winding 14B from the end 48 to the end 50 approximately equal to the voltage increase across the first winding 12B from the end 46 to the first end 20. Furthermore, assuming that the second transmission line 26 is balanced, the second transmission line 26 transformer will decrease the current of the RF intermediary signal 52 by half since the second winding 14B and the third winding 16B are two conductors both resistive and inductive in series. Due to magnetic field cancellations that result in mutual inductance cancellations, the RF intermediary signal 52 will cause a voltage drop across the third winding 16B from the end 58 to the second end 22 approximately equal to the voltage drop across the second winding 14B from the end 48 to the end 50.

As such, a current ratio of the current magnitude of the RF output signal 44 at the second port 30 with respect to the current magnitude of the RF input signal 42 at the first port 28 is approximately equal to approximately 3/4. Furthermore, a voltage ratio of the voltage magnitude of the RF output signal 44 at the second port 30 with respect to the voltage magnitude of the RF input signal 42 at the first port 28 is approximately equal to approximately 1.5. Accordingly, assuming that the second transmission line 26 and the first transmission line 24 are both balanced, the transformer 10B shown in FIG. 5 is configured to provide an impedance transformation of approximately of 2/1 from the first port 28 to the second port 30. Accordingly, the first transmission line 24 and the second transmission line 26 provide an impedance transformation such that a low impedance LI as seen from the first port 28 is converted to an impedance seen from the second port 30 is substantially equal to the high impedance HI as seen from the second port 30.

For example, a 50 Ohm impedance at the first port 28 will result in approximately a 100 Ohm impedance at the second port 30. As explained in further detail below, the ratio of the impedance transformation is inverted from the second port 30 to the first port 28. For example, a 100 Ohm impedance at the second port 30 will result in approximately a 50 Ohm impedance at the first port 28. In this manner, the transformer 10B is configured to provide the impedance transformation that transforms the low impedance LI at the first port 28 to an impedance at the second port 30 that is substantially equal to the high impedance HI at the second port 30.

In this embodiment, a bypass capacitor (such as the bypass capacitive element 40 shown in FIG. 1) is not connected in shunt with respect to the third port 32. Instead, a grounding plate 92 is connected in shunt directly to the third port 32 and the second end 22 of the conductive path 18. Thus, the third port 32 and the second end 22 of the conductive path 18 are grounded. This allows the transformer 10B to be smaller and works very well at low frequencies since the transformer 10B is not have the bypass capacitive element 40 (shown in FIG. 1) blocking a path to ground. Also, since the third port 32 and the second end 22 of the conductive path 18 are directly connected to ground, the transformer 10B is tolerant to relatively high levels of electrostatic discharge (ESD). However, by not having a bypass capacitive element, the transformer 10B is not a bias Tee.

Referring to FIG. 5, the transformer 10B is also symmetrical so as to provide an impedance transformation that transforms the load impedance presented from the second port 30 to the source impedance at the first port 28. More specifically, by providing connecting the first winding 12B, the second winding 14B, and the third winding 16B to form the conductive path 18 and providing the first transmission line 24 and the second transmission line 26, the transformer 10B is configured to define a passband between the second port 30 and the first port 28 and is configured to provide an impedance transformation within the passband in which a load impedance presented at the second port 30 is transformed into an impedance at the first port 28 that substantially matches the source impedance presented at the first port 28. Accordingly, the transformer 10B is configured to provide an impedance transformation between the second port 30 and the first port 28 that is inverse to the impedance transformation between the first port 28 and the second port 30.

In response to the RF input signal 42' being provided at the second port 30, the first winding 12B is connected so that the RF input signal 42' propagates in the counterclockwise current direction from the second port 30 toward the first port 28. The RF input signal 42' propagates through the first winding 12B in the counterclockwise current direction from the first end 20 to the first port 28. The RF input signal 42' results in a voltage drop across the first winding 12B from the first end 20 to the first port 28. As a result, there is a voltage drop from the second port 30 to the first port 28 substantially equal to the voltage drop across the first winding 12B from the first end 20 to the first port 28.

The end 48 of the second winding 14B is connected to the end 46 of the first winding 12B and thus to the first port 28. Furthermore, as mentioned above, the first winding 12B and the second winding 14B form the first transmission line 24. As a result, in response to the RF input signal 42' being received at the second port 30 and propagating through the first winding 12B, the second winding 14B is configured to generate an RF intermediary signal 88 that propagates in the clockwise current direction from the end 50 to the end 48 of the second winding 14B. This results in a voltage increase across the second winding 14B from the end 50 to the end 48 substantially equal to the voltage drop across the first winding 12B from the first end 20 to the first port 28. Accordingly, the RF intermediary signal 88 propagates along the conductive path 18. Accordingly, the RF intermediary signal 88 combines with the RF input signal 42' at the first port 28 to become the RF output signal 44' at the first port 28. There is thus a current increase at the first port 28 with respect to the second port 30 in response to the RF input signal 42' being received at the second port 30.

With respect to the third winding 16B, the third winding 16B is connected in series within the conductive path 18 to the second winding 14B. The end 58 of the third winding 16B is connected to the end 50 of the second winding 14B. This also results in a voltage increase across the third winding 16B from the second end 22 to the end 50. In this embodiment, the voltage increase across the third winding 16B is substantially equal to the voltage increase across the second winding 14B from the end 50 to the end 48 since the second winding 14B and the third winding 16B are considered to be substantially identical. Thus, in response to the RF input signal 42' being received at the second port 30 and propagating through the first winding 12B, the voltage at the first port 28 is substantially equal to the voltage increase across the second winding 14B added to the voltage increase across the first winding 12B. The RF intermediary signal 88 also propagates through the third winding 16B in the clockwise current direction from the second end 22 to the end 58 in response to the RF input signal 42' being received at the second port 30 and propagating through the first winding 12B. The RF intermediary signal 88 propagates across the third winding 16B from the second end 22 to the end 58 in the clockwise current direction, which is the same current direction that the RF intermediary signal 88 propagated though the second winding 14B. The second end 22 of the third winding 16B is oppositely disposed from the end 58 of the third winding 16B.

As mentioned above, the third winding 16B and the second winding 14B form the second transmission line 26. Thus, in response to the RF intermediary signal 88, the second transmission line 26 is configured to generate an RF intermediary signal 90 from the end 48 of the second winding 14B in the counterclockwise current direction from the end 48 to the end 50 in the counterclockwise current direction, which would also result in the RF intermediary signal 90 propagating from the end 58 to the second end 22 of the third winding 16B. However, so long as the magnetic field from the second winding 14B in response to the RF intermediary signal 88 is approximately equal but opposite to the magnetic field generated across the third winding 16B as a result of the RF intermediary signal 88, a mutual inductance between the second winding 14B and the third winding 16B is cancelled, and the second winding 14B and the third winding 16B operates as independent conductors. Thus, the RF intermediary signal 88 will be unaffected by the RF intermediary signal 90, since the RF intermediary signal 90 will not be produced, as the magnetic flux between each of the second winding 14B and the third winding 16B will cancel. However, if there is a noise signal in the second winding 14B and/or the third winding 16B, the magnetic fields will be unbalanced, and the RF intermediary signal 90 will thus be generated until the noise signal is cancelled and the balance between the magnetic fields is restored. The RF intermediary signal 90 thus propagates in the counterclockwise current direction while the RF intermediary signal 88 propagates in the opposite clockwise current direction. Thus, the RF intermediary signal 90 cancels common mode noise signals of the RF intermediary signal 88 and the second winding 14B and the third winding 16B operate as an RF common mode choke.

Assuming that the second transmission line 26 and the first transmission line 24 are both balanced, the first transmission line 24 maintains the voltage drop across the second winding 14B from the end 50 to the end 48 approximately equal to the voltage increase across the first winding 12B from the first end 20 to the end 46 and thus also the voltage increase across the third winding 16B substantially equal to the voltage increase across the second winding 14B. Thus, there is a voltage decrease from the second port 30 to the first port 28 where the voltage ratio is about 2/3. Furthermore, the first transmission line 24 will generate the RF intermediary signal 88 so as to increase the current of the RF output signal 44' at the first port 28. Assuming that the second transmission line 26 and the first transmission line 24 are both balanced, the second winding 14B and the third winding 16B are two conductors both resistive and inductive in series. Due to magnetic field cancellations that result in mutual inductance cancellations, the RF intermediary signal 88 will result in a current increase of the RF output signal 44' at the first port 28 of approximately equal to 1/3 of the current of the RF input signal 42'. Thus, the current ratio from the second port 30 to the first port 28 is 4/3. As a result, the impedance ratio from the second port 30 to the first port 28 is 1/2. Accordingly, within the passband, the transformer 10B is configured for impedance transformation that transforms the high impedance HI at the second port 30 to half its value at the first port 28. Thus, the transformer 10B is configured to transform 100 Ohms at the second port 30 to 50 Ohms at the first port 28.

In second exemplary implementation shown in FIG. 5, adjacent pairs of the windings 12B, 14B, 16B are spaced approximately 4 μm apart. Furthermore, each of the windings 12B, 14B, 16B has a width of approximately 10 μm. The transformer 10B is built with the semiconductor substrate 66 being a 4 millimeter SiC substrate formed using QGaN15 process. The transformer 10B of this second implementation matches to approximately 50 Ohms at the first port 28 with approximately 100 Ohms at the second port 30 and matches approximately 100 Ohms at the second port 30 with the 50 Ohms seen at the first port 28. The transformer 10B has a size of approximately 750 μm×250 μm. The windings 12B, 14B, 16B are substantially elliptical.

Figure 6:
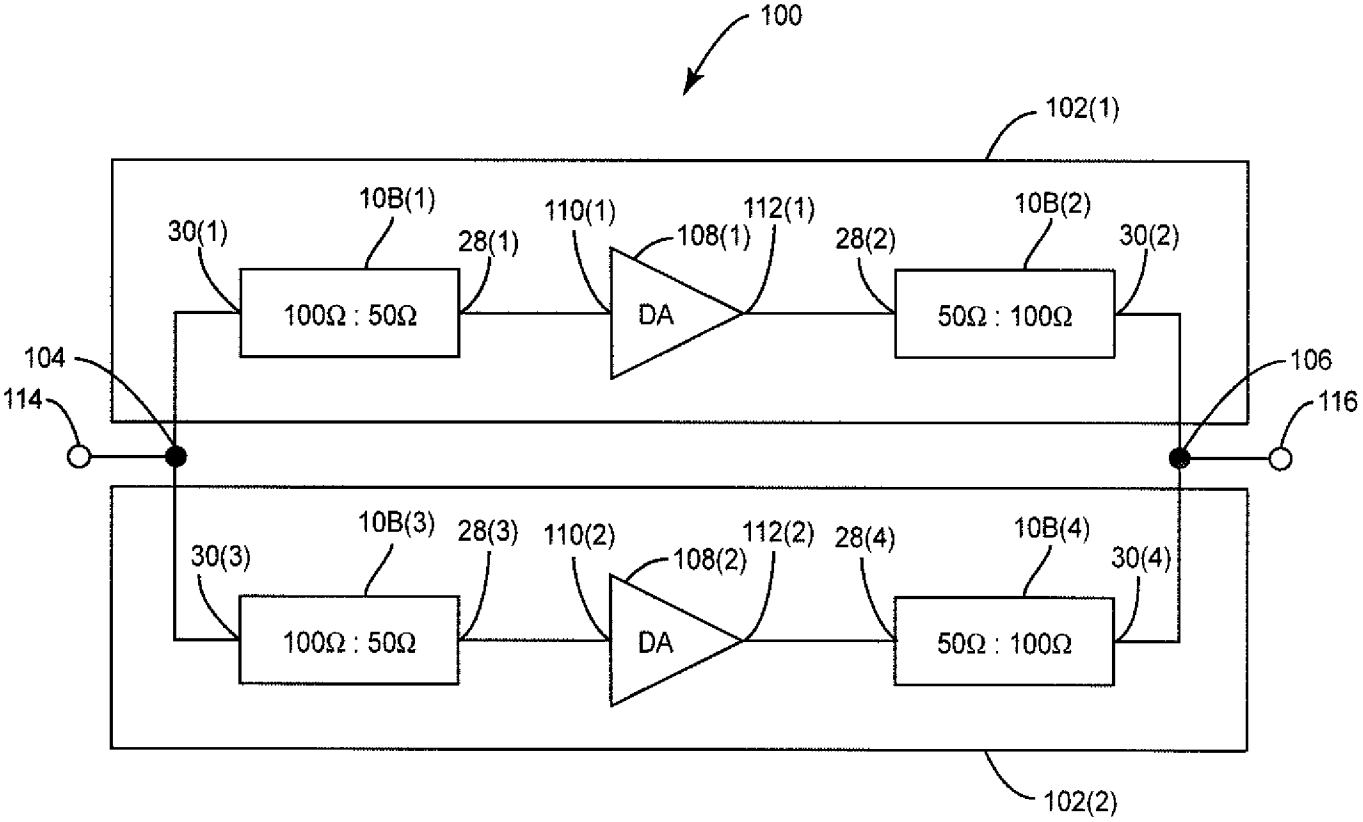
FIG. 6 illustrates one embodiment of an amplifier formed with various transformers that are identical to the transformer shown in FIG. 5.

FIG. 6 illustrates one embodiment of an amplifier 100 formed with transformers 10B(1), 10B(2), 10B(3), 10B(4). Each of the transformers 10B(1), 10B(2), 10B(3), 10B(4) are identical to the transformer 10B shown in FIG. 5. As shown in FIG. 6, the amplifier 100 includes parallel amplification branches 102(1) and 102(2) that are both connected in parallel between an input node 104 and an output node 106. Each of the parallel amplification branches includes an amplification stage 108(1), 108(2) respectively. The amplification stage 108(1) includes an input port 110(1) and an output port 112(1) while the amplification stage 108 (2) includes an input port 110(2) and an output port 112(2). The input node 104 is connected to an input terminal 114 for receiving an RF input signal prior to amplification, and the output node 106 is connected to an output terminal 116 for transmitting an amplified RF signal after amplification.

The transformer 10B(1) has a first port 28(1) and a second port 30(1), just like the first port 28 and the second port 30 shown in FIG. 5. The second port 30(1) is connected to the input node 104 within the amplification branch 102(1) and the first port 28(1) is coupled to the input port 110(1) of the amplifier stage 108(1). In this manner, the transformer 10B(1) is configured to transform the 100 Ohm input impedance at the input node 104 to the 50 Ohm impedance seen at the input port 110(1) of the amplifier stage 108(1).

The transformer 10B(2) has a first port 28(2) and a second port 30(2), just like the first port 28 and the second port 30 shown in FIG. 5. The second port 30(2) is connected to the output node 106 within the amplification branch 102(1) and the first port 28(2) is coupled to the output port 112(1) of the amplifier stage 108(1). In this manner, the transformer 10B(2) is configured to transform the 50 Ohm output impedance at the output port 112(1) of the amplifier stage 108(1) to 100 Ohms at the output node 106.

The transformer 10B(3) has a first port 28(3) and a second port 30(3), just like the first port 28 and the second port 30 shown in FIG. 5. The second port 30(3) is connected to the input node 104 within the amplification branch 102(2), and the first port 28(3) is coupled to the input port 110(2) of the amplifier stage 108(2). In this manner, the transformer 10B(3) is configured to transform the 100 Ohm input impedance at the input node 104 to the 50 Ohm impedance seen at the input port 110(2) of the amplifier stage 108(2).

The transformer 10B(4) has a first port 28(4) and a second port 30(4), just like the first port 28 and the second port 30 shown in FIG. 5. The second port 30(4) is connected to the output node 106 within the amplification branch 102(2) and the first port 28(4) is coupled to the output port 112(2) of the amplifier stage 108(2). In this manner, the transformer 10B(4) is configured to transform the 50 Ohm output impedance at the output port 112(2) of the amplifier stage 108(2) to 100 Ohms at the output node 106. By using the transformers 10B(1), 10B(2), 10B(3) and 10B(4) in the amplifier 100 shown in FIG. 6, which are each identical to transformer 10B described above in FIG. 5, the transformers 10B(1), 10B(2) provide a wideband splitter that transforms 100 Ohms to 50 Ohms as required to provide matching into the amplifier stages 108(1), 108(2) of the amplification branches 102(1), 102(2), respectively. The transformers 10B (3), 10B(4) provide a wideband combiners that transforms 100 Ohms to 50 Ohms as required to provide matching out of the amplifier stages 108(1), 108(2) of the amplification branches 102(1), 102(2) and to the output terminal 116. In this manner, an RF input signal received at the input terminal 114 can be divided and amplified by the different amplifier stages 108(1), 108(2) where amplified signals from each of the amplifier stages 108(1), 108(2) can then be combined and transmitted to the output terminal 116 while maintaining the appropriate impedances along both the amplification branches 102(1), 102(2).

Those skilled in the art will appreciate the scope of the present disclosure and realize additional aspects thereof after reading the following detailed description of the preferred embodiments in association with the accompanying drawing figures

What is claimed is:

1. A transformer comprising:

a first conductor;

a second conductor connected in series with the first conductor wherein the first conductor and the second conductor are disposed so as to operate in a waveguide mode such that a radiated magnetic field and/or electric field from the first conductor and the second conductor field couple the first conductor and the second conductor and form a first transmission line;

a third conductor connected in series with the second conductor wherein the second conductor and the third conductor are disposed so as to operate in a waveguide mode such that a radiated magnetic field and/or electric field from the second conductor and the third conductor field couple the second conductor and the third conductor and form a second transmission line;

a first port coupled so as to provide an intermediary tap to the first transmission line;

a second port coupled to the first conductor; and a third port coupled to the third conductor, wherein the first conductor, the second conductor, and the third conductor define a conductive path between the second port and the third port such that the first conductor, second conductor, and third conductor are connected in series within the conductive path;

at least a portion of the first conductor is connected between the first port and the second port;

the first transmission line is provided such that the first conductor and the second conductor are in a bootstrap arrangement;

the second conductor and the third conductor are connected in series between the first port and the third port so that the second transmission line provides the second conductor and the third conductor in a common mode choke arrangement; and the transformer is configured to provide an impedance transformation that transforms a low impedance presented at the first port to a higher impedance at the second port.

2. The transformer of claim 1 wherein the first conductor, the second conductor, and the third conductor define the conductive path between the second port and the third port such that the first conductor, second conductor, and third conductor are connected in series within the conductive path.

3. The transformer of claim 2 wherein:

the first conductor defines a first end of the conductive path;

the second conductor is connected between the first conductor and the third conductor;

the third conductor defines a second end of the conductive path oppositely disposed to the first end of the conductive path;

at least a portion of the first conductor is connected between the first port and the second port;

the second port is coupled to the first end of the conductive path; and the third port is coupled to the second end of the conductive path.

4. The transformer of claim 3 wherein the first port is connected so as to provide the intermediary tap to the first conductor such that less than a whole portion of the first conductor is connected between the first port and the second port.

5. The transformer of claim 3 wherein the first port is coupled so as to provide the intermediary tap between the first conductor and the second conductor such that a whole portion of the first conductor is connected between the first port and the second port.

6. The transformer of claim 3 further comprising a capacitive element connected in series between the first end of the conductive path and the second port.

7. The transformer of claim 3 further comprising a capacitive element connected in shunt between the third port and the second end of the conductive path.

8. The transformer of claim 3 wherein the second conductor and the third conductor are connected in series within a path that is connected in shunt with respect to the first port.

9. The transformer of claim 1 wherein the first conductor, the second conductor, and the third conductor are arranged so that the transformer is a bias Tee wherein the first port is a low impedance port, the second port is a high impedance port and the third port is a bias port.

10. The transformer of claim 1 whereby the transformer is further configured to provide an impedance transformation that transforms a higher impedance presented at the second port to a lower impedance at the first port.

11. The transformer of claim 1 wherein the transformer is a monolithic microwave integrated circuit (MMIC) integrated into a semiconductor substrate.

12. The transformer of claim 1 wherein:

the first conductor is a first winding;

the second conductor is a second winding; and the third conductor is a third winding.

13. The transformer of claim 12 wherein the first winding, the second winding, and the third winding form a planar coil such that the first winding is an outermost winding, the third winding is an innermost winding, and the second winding is an intermediate winding connected between the first winding and the third winding.

14. The transformer of claim 13 wherein the first winding and the second winding are edge coupled so as to provide the first transmission line.

15. The transformer of claim 14 wherein the second winding and the third winding are edge coupled so as to provide the second transmission line.

16. The transformer of claim 12 wherein:

the first winding defines a first end and a second end, wherein the first end is coupled to the second port and the second end is connected to the second winding; and the first port comprises a terminal connected to an outermost edge of the first winding such that the first port provides an intermediary tap to the first winding so that a portion of the first winding is connected between the first port and the second port.

17. The transformer of claim 14 further comprising a first Metal Insulator Metal (MIM) capacitive element and a second MIM capacitive element wherein:

the first MIM capacitive element is connected in series between the first end and the second port;

the second winding defines a third end that is connected to the second end of the first winding and a fourth end;

the third winding defines a fifth end connected to the fourth end of the second winding and a sixth end connected to the third port; and the second MIM capacitive structure is connected to the sixth end and in shunt with respect to the third port.

18. The transformer of claim 12 further comprising a grounding plate wherein:

the first winding defines a first end and a second end, wherein the first end is directly connected to the second port and the second end is connected to the second winding;

the first port is connected to the second end of the first winding so that the first winding is connected between the first port and the second port;

the second winding defines a third end that is connected to the second end of the first winding and a fourth end;

the third winding defines a fifth end connected to the fourth end of the second winding and a sixth end connected to the third port; and the grounding plate is connected in shunt with respect to the sixth end and to the third port.

* * * * *